United States Patent [19]

Dietrich et al.

[11] 4,197,790

[45] Apr. 15, 1980

[54] METHOD AND APPARATUS FOR OPENING AND HANDLING FOLDED BOXES

[75] Inventors: Walter Dietrich; Manfred Bauer, both of Weinstadt, Fed. Rep. of Germany

[73] Assignee: Robert Bosch GmbH, Stuttgart, Fed. Rep. of Germany

[21] Appl. No.: 901,668

[22] Filed: May 1, 1978

[30] Foreign Application Priority Data

May 10, 1977 [DE] Fed. Rep. of Germany ..... 2720902

[51] Int. Cl.[2] ..... B31B 1/80

[52] U.S. Cl. ..... 93/53 M; 93/53 SD

[58] Field of Search ..... 93/53 SD, 53 R, 53 M, 93/53 BF; 53/564

[56] References Cited

U.S. PATENT DOCUMENTS

| | | | |
|---|---|---|---|
| 2,760,415 | 8/1956 | Hornsteiner | 93/53 SD |
| 3,896,711 | 7/1975 | Vuilleumier | 93/53 SD |
| 3,991,660 | 11/1976 | Calvert et al. | 93/53 SD |
| 4,061,081 | 12/1977 | Pinto et al. | 93/53 SD |

*Primary Examiner*—James F. Coan

*Attorney, Agent, or Firm*—Edwin E. Greigg

[57] ABSTRACT

A single folded carton or box is removed from a magazine and is held by suction cups or the like at one side while being moved into contact with a fixed member which exerts an opening force on the folded box. When thus erected, the box is placed onto a moving conveyor belt for further use. The removal, opening and placement on the conveyor are executed in a substantially single sweeping motion of a transport arm which is moved by a system of articulated levers. After placement of the box on the conveyor, the levers retract the arm and return it to its starting position.

4 Claims, 1 Drawing Figure

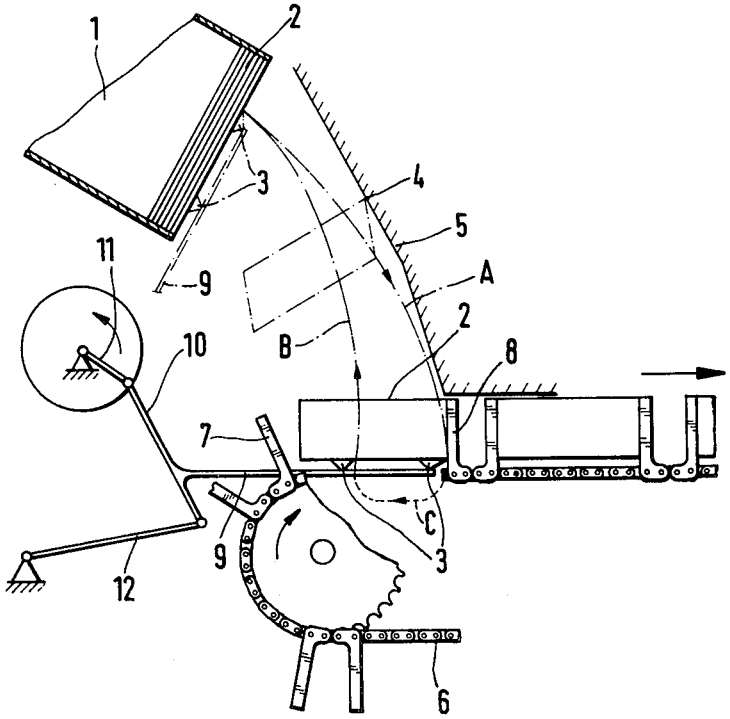
1
2
3
4
5
A
2
8
11
9
10
B
7
9
C
3
12
6

METHOD AND APPARATUS FOR OPENING AND HANDLING FOLDED BOXES

BACKGROUND OF THE INVENTION

The invention relates to the field of package-handling machinery. More particularly, the invention relates to a method and an apparatus for opening or erecting folded boxes and placing them on a suitable conveyor belt for subsequent filling and closing. In a known process with known machinery, folded boxes are removed from a magazine and are erected or opened in a first mechanical movement by suction devices. The boxes are then transported out of the return path of the suction device in a second mechanical displacement. Finally, a third rapid downward movement places the opened box in the conveyor belt with a "slapping" motion.

The execution of these three separate mechanical movements requires a multitude of machine members and control parts resulting in a complicated system and an expensive construction. Further disadvantages of the known method and apparatus are that a change of box sizes is relatively difficult and requires a lengthy adjustment and thus results in relatively high cost. These disadvantages become especially cumbersome in the handling of folded boxes of large size.

OBJECT AND SUMMARY OF THE INVENTION

It is thus a principal object of the present invention to provide a method and an apparatus which performs a relatively simple and uncomplicated opening and erecting of folded boxes and the transport of these boxes to a moving conveyor belt. It is a further principal object of the invention to provide a method and an apparatus which operates simply even when large size boxes are handled. Yet another object of the invention is to provide an apparatus which uses a relatively small number of moving parts for performing the opening and placement of the cardboard boxes.

It is a related object of the present invention to provide an apparatus in which the sweep angle of the suction arms is relatively large, thereby permitting the folded box magazine to be placed at a substantial distance from the conveyor belt and to be positioned at a relatively steep angle therewith. This type of positioning reduces the degree of bulging of the boxes at the opening of the magazine and thus increases its potential capacity.

A still further object and advantage of the present invention is to provide an apparatus having a reduced number of parts, thereby diminishing the chance for malfunctions and permitting simplified changeover of box sizes.

These and other objects are attained according to the invention by providing an apparatus in which the box handling suction arm executes a substantially single sweeping motion during its box transport during which the folded box engages a locally fixed rail which causes it to open up. The transfer of the opened box to the conveyor belt is made at the end of the single sweeping motion of the transport arm.

The invention will be better understood as well as further objects and advantages thereof become more apparent from the ensuing detailed description of a preferred embodiment taken in conjunction with the drawing.

BRIEF DESCRIPTION OF THE DRAWING

The single FIGURE of the drawing is a partially schematic front elevational illustration of an apparatus according to the invention suitable for carrying out the method of the invention.

DESCRIPTION OF THE PREFERRED EMBODIMENT

Turning now to the single FIGURE, there will be seen a magazine 1 for holding folded boxes or cartons 2. Suction devices 3 mounted on an arm 9 can be moved into juxtaposition with the bottommost of the folded cartons 2 as illustrated in dash-dotted lines. During the downward stroke of the arm 9, i.e. along the dash-dotted path A, the folded carton encounters a locally fixed rail 5 which makes contact with an edge 4 of the folded carton. The top of the box being free to move under the influence of the force exerted by the rail 5, the box then opens as shown in dash-dotted lines and the arm continues to carry it downwardly along the path of A into the position shown in solid lines. In that final position, the box is placed between the transport stakes 7 and 8 of a moving conveyor belt 6 which is powered by means not shown and moves in the direction illustrated by the arrows. The arm 9 which carries the suction devices 3 is moved by a system of levers 10, 11, 12, one end of the lever 11 being locally pivoted while the other end is moved in a circle as illustrated by the arrow. The system of levers 10,11 and 12 is thus seen to be pivoted at a total of 4 pivoting points, the outer two of which are locally fixed to the frame of the machine or the ground. The operation of the machinery described above is as follows: From the position of the arm 9 shown in dash-dotted lines, the latter moves downwardly along the curve labeled A into the solidly drawn position. During the downward motion along the curve A, the bottom of each carton 2 remains in contact with the suction devices 3 due to the application of vacuum. The box is opened in a manner described above by contact with the rail 5. When the arm 9 reaches its downward limit, and the open box 2 is placed on the conveyor 6 between the carrier stakes 7 and 8, the speed of the suction devices in the direction of travel of the conveyor belt, i.e. to the right as shown in the FIGURE, is approximately the same as that of the conveyor belt itself. This identity of speeds is obtained by suitable adjustment of the speeds of motion of the conveyor belt and/or of the system of levers 10, 11 and 12 including the choice of their relative dimensions. Immediately after deposition of the open box 2 on the conveyor belt 6, the arm 9 is retracted to the left as seen in the FIGURE so that the suction devices 3 travel along the path indicated by the dashed line C while the box 2 is being transported in the opposite direction at the speed of the conveyor belt 6. The added relative motions of these two members cause the carrier arm 9 to be rapidly removed from the vicinity of the box 2, thereby permitting its rapid upward displacement along the dash-dotted line labeled B. The speed of the upward motion is chosen to be relatively fast by suitable dimensioning of the individual levers 10, 11 and 12 and their drive means. The terminus of the upward motion along the curve B is identical to the beginning of the downward motion along the curve A. The motion of points lying along the arm 9, when moving toward and away from the bottommost carton, is substantially perpendicular to the plane of the bottommost carton in the magazine 9 to permit simultaneous contact of several suction devices 3.

The suction devices 3 may be connected by suitable hoses or tubes to a source of vacuum, not shown but of standard and known construction.

The foregoing relates to a preferred exemplary embodiment of the invention, it being understood that other embodiments and variants thereof are possible within the spirit and scope of the invention.

What is claimed and desired to be secured by Letters Patent of the United States is:

1. In a method for opening a folded box and preparing it for use, the improvement comprising the steps of:

removing a single folded box from a plurality of folded boxes in a magazine and holding it so as to permit relative movement of parts thereof;

putting said single folded box in moving contact with a locally fixed member, causing opening forces to be exerted on parts of said folded box to thereby define an internal space;

placing the opened box onto a moving conveyor belt;

and wherein the steps of removing, putting and placing said box are performed in a substantially single sweeping movement along a continuous path extending between successive removing steps including a portion of said sweeping movement subsequent to said placing step in a direction opposite to the direction of movement of said conveyor belt.

2. An apparatus for opening a folded box and preparing it for use, comprising:

a container for holding a plurality of folded boxes;

transport means for grasping a single one of said folded boxes and holding it so as to permit relative movement of parts thereof and for moving it in a substantially single sweeping movement in a continuous path which begins and ends adjacent said container;

a locally fixed rail so placed as to be in contact with a part of said single box held by said transport means during said sweeping movement to thereby exert forces on a part of said box causing it to open, thereby defining an interior space;

a conveyor belt for receiving the opened box from said transport means during said sweeping movement; and a system of articulated levers, connected to said transport means, for causing said transport means to periodically execute said substantially single sweeping movement along said continuous path, a portion of said sweeping movement including a movement in a direction opposite to the movement of said conveyor belt.

3. An apparatus as defined by claim 2, wherein said system of levers is a system of three serial levers turning on four pivots, the outer pivots being locally stationary and the central lever carrying means for grasping and holding said single folded box.

4. An apparatus as defined by claim 3, wherein said carrying means for grasping and holding include suction cups.

* * * * *